US010358793B2

(12) United States Patent
Risi

(10) Patent No.: US 10,358,793 B2
(45) Date of Patent: Jul. 23, 2019

(54) EXCAVATING EQUIPMENT FOR EXCAVATING SURFACES

(71) Applicant: SIMEX ENGINEERING S.R.L., San Giovanni in Persiceto (IT)

(72) Inventor: Mirco Risi, San Giovanni in Persiceto (IT)

(73) Assignee: Simex Engineering S.R.L., San Giovanni (Bologna) (IT)

( * ) Notice: Subject to any disclaimer, the term of this patent is extended or adjusted under 35 U.S.C. 154(b) by 0 days.

(21) Appl. No.: 15/760,124

(22) PCT Filed: Sep. 15, 2016

(86) PCT No.: PCT/IB2016/055487
§ 371 (c)(1),
(2) Date: Mar. 14, 2018

(87) PCT Pub. No.: WO2017/046725
PCT Pub. Date: Mar. 23, 2017

(65) Prior Publication Data

US 2018/0258611 A1 Sep. 13, 2018

(30) Foreign Application Priority Data

Sep. 15, 2015 (IT) ..... 102015000051758

(51) Int. Cl.
*E02F 5/08* (2006.01)
*E01C 23/09* (2006.01)
(Continued)

(52) U.S. Cl.
CPC ..... *E02F 5/08* (2013.01); *E01C 23/088* (2013.01); *E01C 23/0933* (2013.01);
(Continued)

(58) Field of Classification Search
CPC ..... E01C 23/09; E01C 23/0933; E02F 3/183; E02F 3/188; E02F 5/08; E21C 25/10; E21C 25/18
(Continued)

(56) References Cited

U.S. PATENT DOCUMENTS 5,287,933 A * 2/1994 Lindblom ..... E02F 3/188 172/112
5,354,147 A * 10/1994 Swisher, Jr. ..... E01C 23/088 172/435
(Continued)

FOREIGN PATENT DOCUMENTS

| | | |
|---|---|---|
| EP | 1197601 | 4/2002 |
| GB | 2468785 | 9/2010 |
| WO | 01/25545 | 4/2001 |

OTHER PUBLICATIONS

International Search Report and Written Opinion dated Jan. 25, 2017 for corresponding PCT patent application No. PCT/IB2016/055487.

*Primary Examiner* — Gary S Hartmann
(74) *Attorney, Agent, or Firm* — Abelman, Frayne & Schwab

(57) ABSTRACT

Equipment for excavating and/or digging trenches in solid surfaces the equipment including a digging wheel rotationally fixed to a main frame, and an adjustment frame defining at least one substantially flat contact portion adapted to be placed in contact with a corresponding portion of the surface to be worked, where the position of the adjustment frame with respect to the main supporting frame can be adjusted so as to adjust the working depth of the digging wheel; and where the adjustment frame is rotationally disengaged from the main supporting frame so that the adjustment frame
(Continued)

always rests on the surface to be worked irrespective of particular working conditions.

18 Claims, 7 Drawing Sheets

(51) Int. Cl.
*E02F 3/18* (2006.01)
*E01C 23/088* (2006.01)
*E21C 25/18* (2006.01)
*E02F 5/06* (2006.01)

(52) U.S. Cl.
CPC ..... *E02F 3/183* (2013.01); *E02F 3/188* (2013.01); *E02F 5/06* (2013.01); *E21C 25/18* (2013.01)

(58) Field of Classification Search
USPC ..... 37/94; 299/39.1, 39.3, 39.6; 404/94
See application file for complete search history.

(56) References Cited

U.S. PATENT DOCUMENTS 5,373,902 A 12/1994 Lindblom
5,823,707 A * 10/1998 Lodovico ..... E02F 3/20 404/91
5,893,677 A * 4/1999 Haehn ..... E01C 23/088 299/39.4
8,375,605 B2 * 2/2013 Ruhl ..... E02F 3/183 37/91
8,806,784 B2 * 8/2014 Ruhl ..... E02F 3/183 37/91
9,695,573 B2 * 7/2017 Sewell ..... E02F 5/14
9,752,301 B2 * 9/2017 Ruhl ..... E02F 3/183
2016/0376767 A1 * 12/2016 Miller ..... E02F 5/08 37/94
2017/0022674 A1 * 1/2017 Stark ..... E01C 23/0933
2017/0101746 A1 * 4/2017 Sewell ..... E01C 23/0933
2017/0254046 A1 * 9/2017 Risi ..... E02F 3/183

* cited by examiner

EXCAVATING EQUIPMENT FOR EXCAVATING SURFACES

CROSS REFERENCE TO RELATED APPLICATIONS

This application is a national phase of PCT application No. PCT/IB2016/055487, filed Sep. 15, 2016, which claims priority to IT patent application No. 102015000051758, filed Sep. 15, 2015, all of which are incorporated herein by reference thereto.

TECHNICAL FIELD OF THE PRESENT INVENTION

The present invention relates to the excavation of surfaces, in particular of solid floors, such as floors made of concrete, asphalt or similar solid materials, for example. The present invention thus relates to equipment for digging ditches and/or trenches of predetermined width and/or depth in surfaces and/or floors of the aforesaid type. In detail, the present invention relates to a solution for adjusting the working depth of equipment of the aforesaid type; even more in detail, the present invention relates to a solution aimed at allowing the automatic positioning of equipment of the aforesaid type in the best possible working condition.

PRIOR ART

Machines and/or equipment for working surfaces, in particular solid surfaces and/or floors, e.g. made of concrete and/or asphalt and/or similar solid materials, are known and widely used in the prior art. For example, milling machines, in particular hydraulic, are known for demolishing and/or milling solid surfaces of the aforesaid type. Excavating machines and/or equipment, usually of hydraulic type, are also known for obtaining and/or digging trenches of predetermined width and/or depth in solid surfaces and/or floors of the aforesaid type. In particular, the increasingly stringent need to lay piping (e.g. for gas or water), but also electrical cables and/or telephone wires, optical fibers etc., has led the manufacturers of equipment of the aforesaid type, simply named trenchers, to dedicate considerable efforts to developing trenchers which are increasingly more reliable and/or better performing. However, the trenchers of known type still display drawbacks which condition their performance.

A trencher of known type typically comprises a digging wheel or disc provided with digging teeth or punches which, during the rotation of the wheel, engage the layer to be worked (e.g. a floor in which it is intended to dig at least one trench), where the waste material is removed and taken to the surface. In particular, the digging wheel is typically rotated by a hydraulic motor fixed to the main supporting frame which, in particular, comprises an attachment 13 by means of which the equipment may be applied to a main operating machine. The motor and the respective trenching wheel are thus fixed to the main frame in predetermined position. Equipment of the aforesaid type is further known, which also comprises an adjustment frame intended to allow the adjustment the excavation depth. The adjustment frame is indeed fixed to the main supporting frame by means of adjustment means, e.g. a jack, a hydraulic piston or similar means, which can be alternatively elongated or shortened, or which are respectively extensible or retractable, by means of which the reciprocal position of the adjustment frame can be adjusted.

Finally, equipment of the aforesaid type is also known in which the main frame and the adjustment frame are rotationally disengaged and may be mutually rotated on a main rotation axis, which is substantially parallel to the rotation axis of said working or digging means.

In particular, in equipment of the latter type, the fact that the main supporting frame can be rotated, at least within given limits, without rotationally feeding the adjustment frame, allows to compensate for incorrect positioning of the main supporting frame (e.g. excessively inclined forwards or backwards), where the adjustment frame keeps its correct position with respect to the surface to be worked instead.

However, the equipment of known type described above, although appreciable from different points of view, is not entirely free from drawbacks and/or disadvantages.

For example, a first disadvantage relates to the fact that the width of the angular sector (the angle) within which the main supporting frame and the adjustment frame are reciprocally and rotationally disengaged it is too limited and does not allow to compensate for improper positioning of the main frame, e.g. caused by a particularly rough and/or irregular surface (on which the adjustment frame rests). Indeed, it is apparent for those skilled in art that, for example, an adjustment frame which is rotationally disengaged from the main supporting frame within an angular sector of at most 30° (in other words, an adjustment frame rotational with respect to the main frame by at most 30°) will not allow to completely compensate for improper orientations of the main frame with respect to the surface to be worked which are greater than 30° (in which the angle or sector between the main frame and the surface to be worked is greater than 30°).

A further drawback of the equipment of known type with rotationally disengaged main frame and adjustment frame relates to the solutions adopted for rotationally disengaging the main frame and the adjustment frame. Indeed, the solutions of known type are also often difficult to be provided, with consequent increase of time for manufacturing the entire equipment, and thus of production costs.

Additionally, the solutions of known type are often such as to weaken the reciprocal constraint between main frame and adjustment frame, with the consequent reduction of stability of the entire structure or at least of undesired play which is formed during the use of the equipment making the reciprocal positioning of the two frames always less accurate.

It is thus the main purpose of the present invention to overcome or at least minimize the drawbacks found in the equipment according to the prior art. In particular, it is an object of the present invention to overcome the drawbacks of the equipment according to the prior art described above. In detail, it is a further object of the present invention to provide equipment of the aforesaid type in which the working depth is adjustable, and possibly in which the resting surface on the ground of the adjustment frame is always substantially completely in contact with the surface to be worked, substantially irrespective of the orientation of the main frame with respect to the aforesaid surface. It is a yet another object of the present invention to provide equipment in which the adjustment of the reciprocal position of the main frame and of the adjustment frame, and thus of the digging or working depth, is such as to ensure the perfect resting of the adjustment frame on the ground, irrespective of the working depth set by means of depth adjustment means.

It is a further object of the present invention to suggest a solution which allows to increase the width of the sector or the angle within which the main frame and the adjustment frame can be rotationally disengaged.

It is also an object of the present invention to suggest a solution which allows to adjust the digging depth and/or the reciprocal rotational disengagement of the main frame and of the adjustment frame which is easy to be implemented and made at low cost, which is not such as to weaken the reciprocal constraint between the two frames and where no undesired play or slack is generated in the reciprocal constraint between the two frames.

Given the objects summarized above, the present invention is based on the general assumption according to which these objects can be achieved by means of equipment in which the adjustment frame has a slot (e.g. closed and of elongated shape) for accommodating at least one portion of actuating means of the digging means, which firstly allows the translation and possibly also the reciprocal rotation of the main supporting frame and of the main supporting frame.

DESCRIPTION OF THE PRESENT INVENTION

On the basis of the assumptions above, the present invention relates to equipment for excavating solid surfaces or floors, such as made of asphalt or concrete or similar solid materials, for example, in particular for obtaining or digging trenches in said solid surfaces or floors, said equipment comprising a main supporting frame and rotatable working or digging means, which are rotationally fixed to said main supporting frame, a power source for actuating said working or digging means fixed to said main supporting frame and an adjustment frame, which defines at least one substantially flat contact portion adapted to be placed in contact with a corresponding portion of the surface to be worked; where said adjustment frame comprises a first guiding slot, through which at least one portion of said power source extends, said power source being translatable within said first slot, said adjustment frame being thus translatable with respect to said main supporting frame, where the translation of said adjustment frame is defined by the reciprocal engagement of said at least one portion of said power source and said first guiding slot.

According to an embodiment, said adjustment frame may be further rotated with respect to said main supporting frame (11), e.g. to the longitudinal extension axis of said power source.

Preferably, said main supporting frame and said adjustment frame may be reciprocally fixed by means of an engagement pole or pin extending in a direction substantially parallel to said longitudinal extension axis of said power source, where said engagement pole or pin may engage, for example, a second engagement slot, and where said second engagement slot may extend, for example, along an arc-shaped or semi-circular development centered on said longitudinal extension axis of said power source, said engagement pin or pole being in this case translatable along said second engagement slot on a plane which is substantially perpendicular to said longitudinal extension axis of said power source.

According to an embodiment, the equipment according to the present invention may comprise a third guiding slot in which a guiding element is engaged, which extends along a direction parallel to the extension direction of said pin or pole, said element being translatable in this case along said third guiding slot, said third guiding slot and said first guiding slot extending along developments which substantially overlap according to a side view substantially parallel to said longitudinal extension axis of said power source.

Advantageously, the equipment according to the present invention may comprise adjustment means adapted to allow to adjust the position of said adjustment frame with respect to said main supporting frame so as to allow to adjust the working depth of said working means, said adjustment means comprising, for example, a first fixing arm which is rotationally fixed to said main supporting frame by means of which said adjustment frame is fixed to said main frame, so that by rotating said fixing arm about its rotation axis in two opposite rotation directions, a translation of said adjustment frame is obtained with respect to said main supporting frame in two opposite translation directions, respectively.

The equipment according to the present invention may advantageously comprise actuating means which are alternatively extensible and retractable so that the extension of said actuating means translates into a rotation of said adjustment means in one rotation direction and the retraction of the said actuating means translates into a rotation of said arm in the opposite rotation direction.

It is a further object of the present invention an operating machine for excavating solid surfaces, such as made of asphalt or concrete or similar solid materials, for example, in particular for digging trenches in said solid surfaces, said operating machine being equipped with equipment according to the present invention.

The present invention further relates to equipment for excavating solid surfaces or floors (S), such as made of asphalt or concrete or similar solid materials, for example, in particular for digging trenches in said solid surfaces or floors, said equipment comprising a main supporting frame and rotatable working or digging means, which are rotationally fixed to said main supporting frame, a power source for actuating said working or digging means fixed to said main supporting frame and an adjustment frame, which defines at least one substantially flat contact portion adapted to be placed in contact with a corresponding portion of the surface to be worked; where said adjustment frame comprises a first guiding slot through which at least one portion of said power source extends, said power source being translatable within said first slot, said adjustment frame being thus translatable with respect to said main supporting frame, where the translation of said adjustment frame is defined by the reciprocal engagement of said at least one portion of said power source and said first guiding slot; where said power source defines a longitudinal extension axis and where said adjustment frame is rotational about said main supporting frame with respect to said longitudinal extension axis of said power source. The present invention further relates to equipment for excavating solid surfaces or floors, such as made of asphalt or concrete or similar solid materials, for example, in particular for obtaining or digging trenches in said solid surfaces or floors, said equipment comprising a main supporting frame and rotatable working or digging means, which are rotationally fixed to said main supporting frame, a power source for actuating said working or digging means fixed to said main supporting frame and an adjustment frame, which defines at least one substantially flat contact portion adapted to be placed in contact with a corresponding portion of the surface to be worked; where said adjustment frame comprises a first guiding slot through which at least one portion of said power source extends, said power source being translatable within said first slot, said adjustment frame being thus translatable with respect to said main supporting frame, where the translation of said adjustment frame is defined by the reciprocal engagement of said at least one portion of said power source and said first guiding slot; where said main supporting frame and said adjustment frame are reciprocally fixed by means of an engagement pole or pin extending in a direction substantially parallel to said longitudinal extension axis of said power source, where said engagement pole or pin engages a second engagement slot, and where said second engagement slot may extend along an arc-shaped or semi-circular development centered on said longitudinal extension axis of said power source, said engagement pin or pole being thus translatable along said second engagement slot on a plane which is substantially perpendicular to said longitudinal extension axis of said power source.

Further embodiments of the equipment and of operating machine according to the present invention are defined in the dependent claims.

BRIEF DESCRIPTION OF THE DRAWINGS

The present invention will be clarified below by describing some embodiments shown in the accompanying drawings. It must be noted that the present invention is not limited to the embodiments shown in the accompanying drawings; on the contrary, all the variants and changes to the embodiments shown and described below which will be clear, apparent and immediate to those skilled in the art are included in the scope of the present invention. In particular, in the accompanying drawings.

FIGS. from 1*a* to 1*c* each show a side view of a trencher according to an embodiment of the present invention, in which the adjustment frame of the equipment is not shown for clarity.

Figure 5:
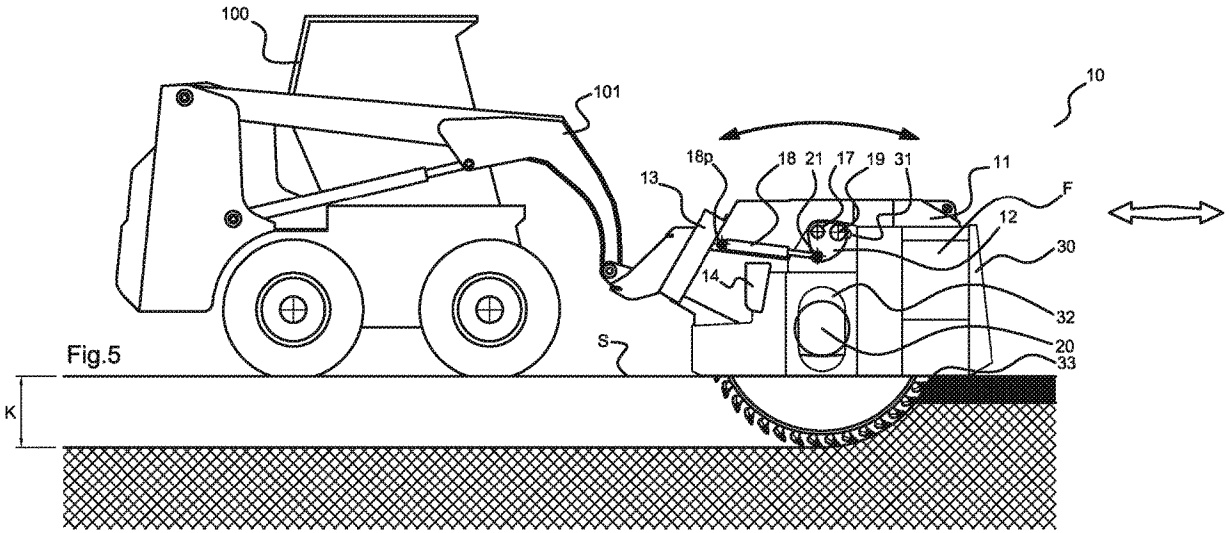
Figure 6B:
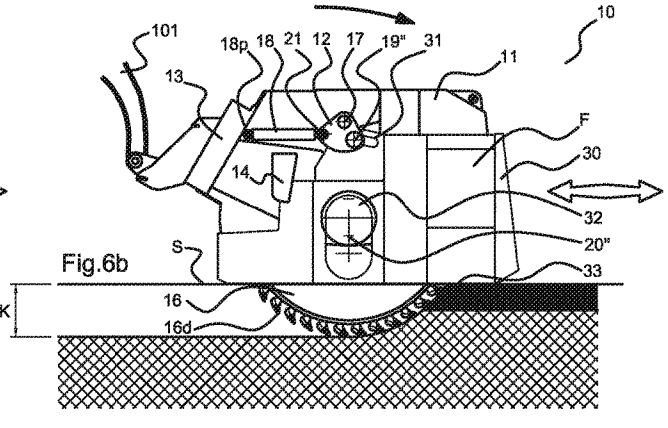
Figure 6A:
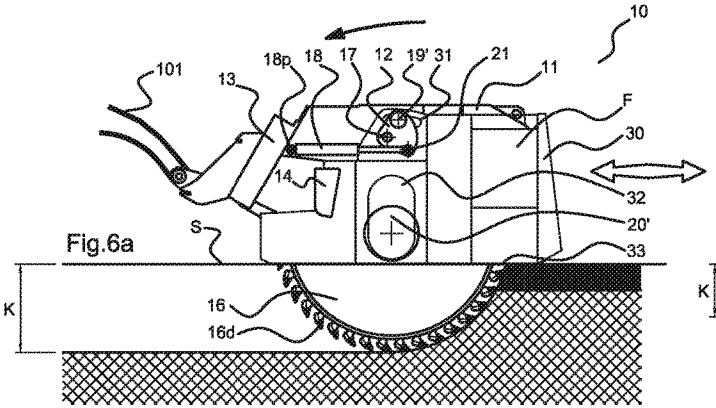

FIGS. from 4*a* to 4*c* show side views of the equipment according to the present invention in respectively different working conditions;

FIG. 5 shows a side view of an operating machine equipped with equipment according to an embodiment of the present invention;

FIGS. 6*a* and 6*b* show side views of equipment according to an embodiment of the present invention in respectively different working conditions.

DETAILED DESCRIPTION OF THE PRESENT INVENTION

The present invention is particularly and effectively applied to equipment for digging trenches and/or ditches; for this reason, hereinafter, the present invention will be described with particular reference to application to a trencher.

However, the possible applications of the present invention are not limited to trenchers; on the contrary, the present invention can be effectively and conveniently applied to different equipment, such as for example milling equipment for milling surfaces or, in all cases, for working and/or demolishing surfaces, in particular solid surfaces.

The methods of using or employing the equipment according to the present invention can be appreciated with reference to FIGS. 5, 6*a* and 6*b*.

As shown, during the digging of the trench, with the digging wheel or disc 16 rotating, the operating machine 100 is either advanced or retracted, respectively, in one of the two directions indicated by the double arrow (either from the right leftwards or from the left rightwards in the figure) so as to respectively either push or feed equipment 10, and thus make it either advance or retract in the same advancement direction. For clarity, hereinafter it is assumed that the operating machine 100, and thus the equipment 10, moves from the left rightwards. In the ideal condition shown in FIG. 5, the equipment is positioned correctly with respect to the surface S by means of the arm 101 of the operating machine 100 and the resting surfaces 33 (the adjustment frame 30, see the detailed description below) are completely in contact with the surface S and during the operations, with the digging wheel 16 rotating, the waste and/or infill material is unloaded from the interior of equipment 10 outwards by means of dumping windows F (one or more on each side of the adjustment frame 30, or also only on a single side, the number and position of the windows F being variable from model to model). FIG. 6*a* instead shows the situation which occurs following an incorrect positioning of arm 101, in this case excessively low with respect to the surface S, where the non-ideal positioning of arm 101 could be caused by an incorrect maneuver of the machine operator 100, for example. With respect to the situation in FIG. 5, the main frame 11 of the equipment (connected to arm 101 by means of attachment 13) may be rotated counterclockwise. Since the adjustment frame 30 is rotationally disengaged from the main frame 11, with respect to the situation in FIG. 5, instead of following the frame 11 in its counterclockwise rotation frame 30, with respect to the situation in FIG. 5, will have kept its position with respect to the surface S, i.e. with the resting surfaces 33 completely in contact with the surfaces S.

FIG. 6*b* shows the situation in which, with respect to the situation in FIG. 5, the main frame is rotated clockwise; also in this case, however, by virtue of the fact that the adjustment frame 30 is disengaged with respect to the main frame 11, the adjustment frame 30 will keep its position with respect to the surface S, i.e. with the resting surfaces 33 perfectly in contact with the surface S.

It can thus be inferred that the set digging depth K is kept also if the main frame 11 is not positioned ideally with respect to the surface S to be worked or dug.

The purely and typically mechanical features of the equipment according to the embodiment of the present invention will be described hereinafter with reference to FIGS. from 1*a* to 1*c* and FIG. 2.

Figure 2:
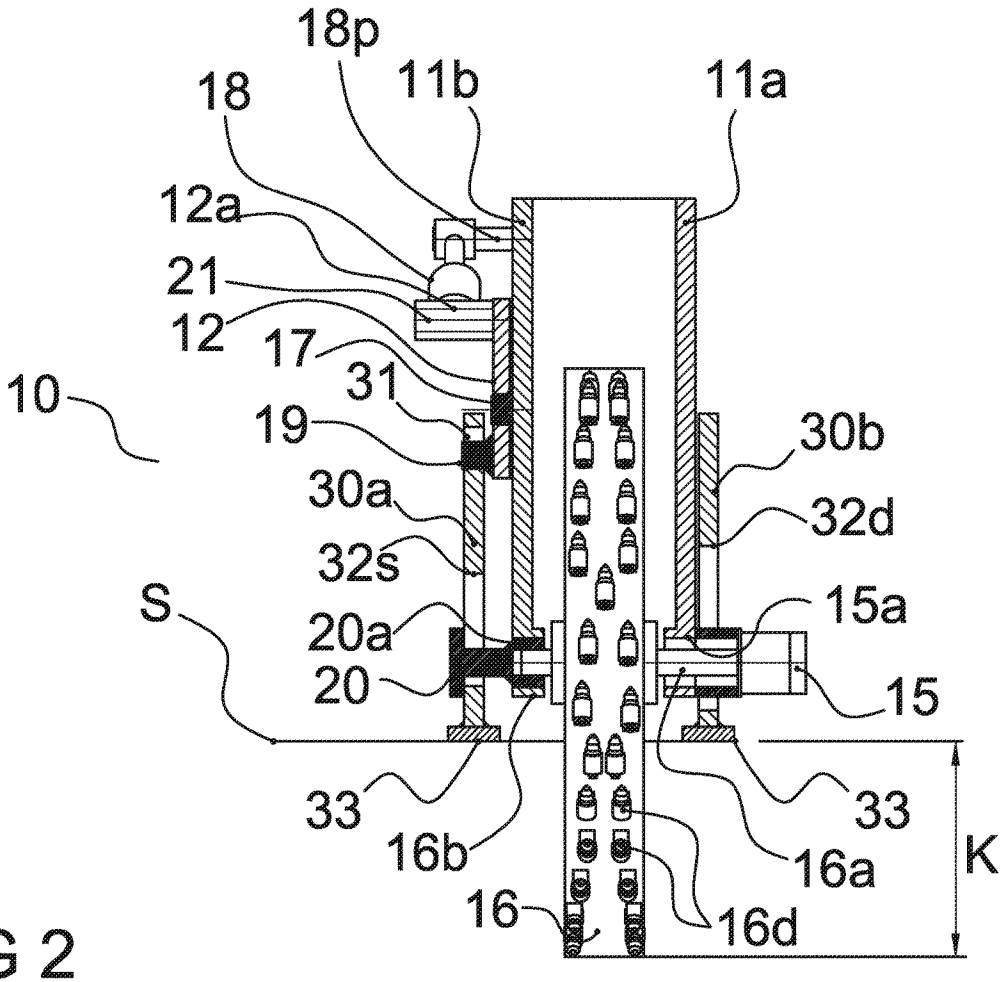
FIG. 2 shows a section view of equipment according to an embodiment of the present invention.

The equipment according to the embodiment of the present invention shown in the FIGS. from 1*a* to 1*c* and in FIG. 2 is identified by reference numeral 10 as a whole, where the adjustment frame of the equipment is not shown for clarity in FIGS. from 1*a* to 1*c*. In particular, equipment 10 comprises a main supporting frame 11 with a general type attachment 13 for the operative coupling of equipment 10 to the mobile arm or support of an operating machine and/or main tractor (see the description above). The main supporting frame 11 substantially consists of two parallel plates defining an inner housing space of the digging means substantially consisting of a digging wheel or disc 16 provided with digging teeth or punches 16*d* arranged on its peripheral outer surface; in a substantially known manner, by rotating the digging wheel 16 in the rotation direction indicated by the arrows in FIGS. 3*a* and 3*b* (either clockwise or counterclockwise rotation with respect to the figure) the punches or teeth 16*d* are engaged in the layer to be worked (e.g. in the ground, in a floor but also in a non-horizontal wall), where the waste material is removed and taken to the surface, in particular dumped outside the adjustment frame (see the description above). In all cases, it must be considered that the applications of the present invention are not limited to trenchers with digging wheel or disc but also comprise chain trenchers, for example. In the case of the digging wheel shown in the figures, a rotation axle 16*a* (FIG. 2) of the digging wheel 16 rotationally extends between the two parallel plates of the main frame 11, where the digging wheel 16 is rotated by means of a power source 15, e.g. a hydraulic motor which rotates the axle 16*a*. In particular, motor 15 extends through plate 11*a* and is thus accommodated in a housing 15*a* of plate 11*a*, in coaxial position with the axle 16*a*, where the shape and size of the housing 15*a* substantially correspond to the shape and size (according to an orthogonal section) of the portion of motor 15 which engages the through housing 15*a*. On the opposite side to motor 15, the end of the axle 16*a* engages an end portion 20*a* of a supporting element 20, where the end portion 20*a* engaged by the axle 16*a* is accommodated in a housing 16*b* of plate 11*b* having shape and size substantially corresponding to the shape and size (taken along an orthogonal section) of the portion 20*a*, the element being rigidly fixed to plate 11*b* by means of the portion 20*a*, the axle 16*a* instead being rotational with respect to element 20.

Figure 1C:
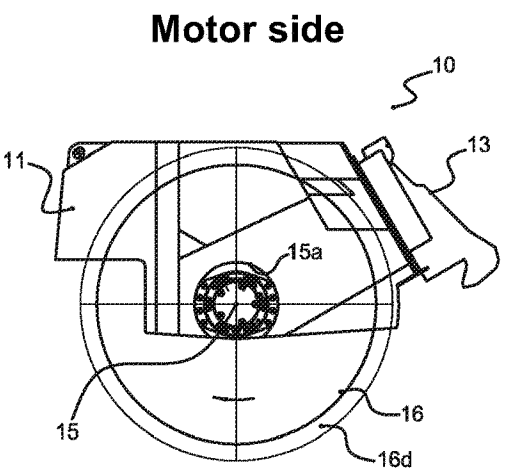
Figure 1B:
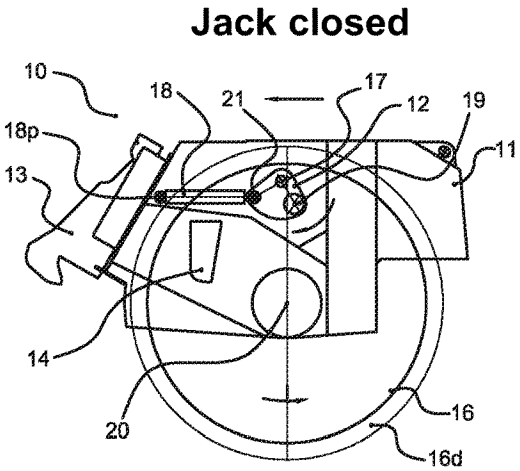
Figure 1A:
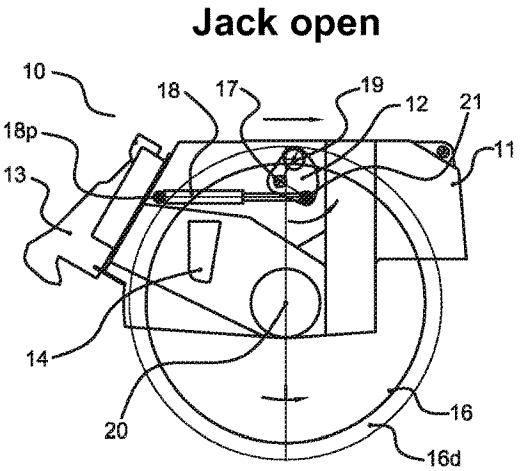

A second axle 18*p* extends from the plate 11*b* of frame 11 towards the exterior of the frame 11 itself (on the side of plate 11*b* opposite to plate 11*a*). Furthermore, a pole or pivot 17 extends from plate 11*b*, again towards the exterior of the frame 11; a fixing and/or adjustment arm 12 pivots on the rotation or pivoting pole 17 and is adapted to be rotated with respect to the rotation axis defined by the pole or pivot 17 in the two rotation directions indicated by the arrows in FIGS. 1*a* and 1*b*, respectively, and thus between the two end positions shown in FIGS. 1*a* and 1*b*, respectively. Furthermore, in FIG. 2, it is apparent that the fixing and/or adjustment element or arm 12 consists of a plate placed outside plate 11*b* and parallel to the plate 11*b* itself. An axle 21 also extends outwards (on the opposite side of the plate 12 with respect to plate 11*b*), from the fixing and/or adjustment plate or arm or rotational element 12. Alternatively extendable or retractable actuating means, e.g. a hydraulic piston 18, are arranged between the axle 18*p* of the main supporting frame 11 and the axle 21 of the fixing and/or adjustment arm or element 12. With particular reference to FIGS. 1*a* and 1*b*, it can be inferred that the extension of the piston 18 (from the left rightwards in the figures) translates into a counterclockwise rotation of arm 12 with respect to the pole or pivoting pin 17, while on the contrary a shortening of the piston 18 (from the right leftwards in the figures) translates into a clockwise rotation of arm 12 again with respect to the pole or pivoting pin 17. So, considering that, as shown in the figures, an engagement pole or pin 19 extends outwards from the adjustment plate or arm or element 12, it can thus be appreciated, with particular reference to FIGS. 1*a* and 1*b*, that a counterclockwise rotation of arm 12 corresponds to an upward travel of pole 19, while on the contrary a clockwise rotation of arm 12 translates into a downward travel of the pole or pin 19.

Figure 3A:
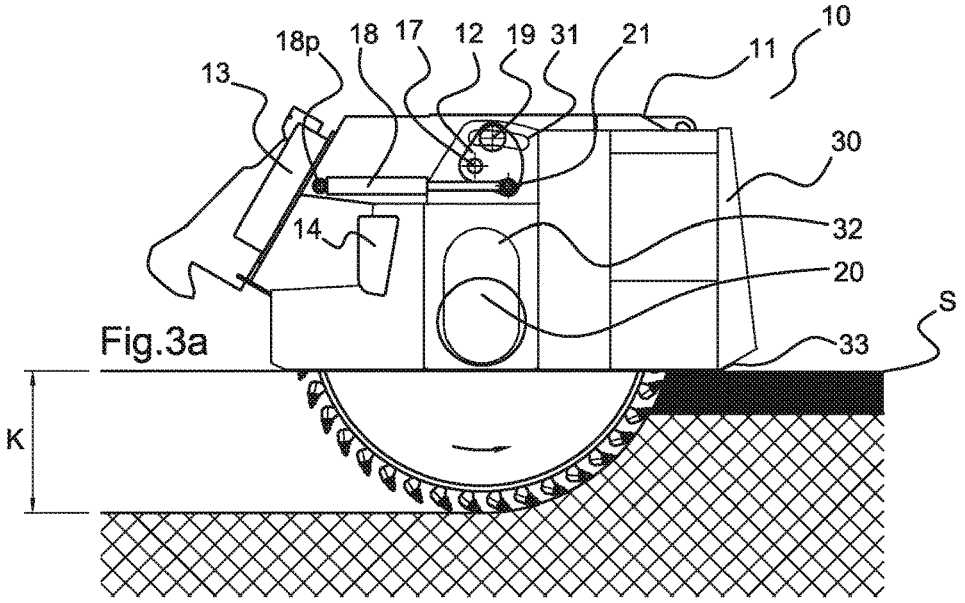
FIGS. 3*a* and 3*b* each show a side view of a trencher according to an embodiment of the present invention.
Figure 3B:
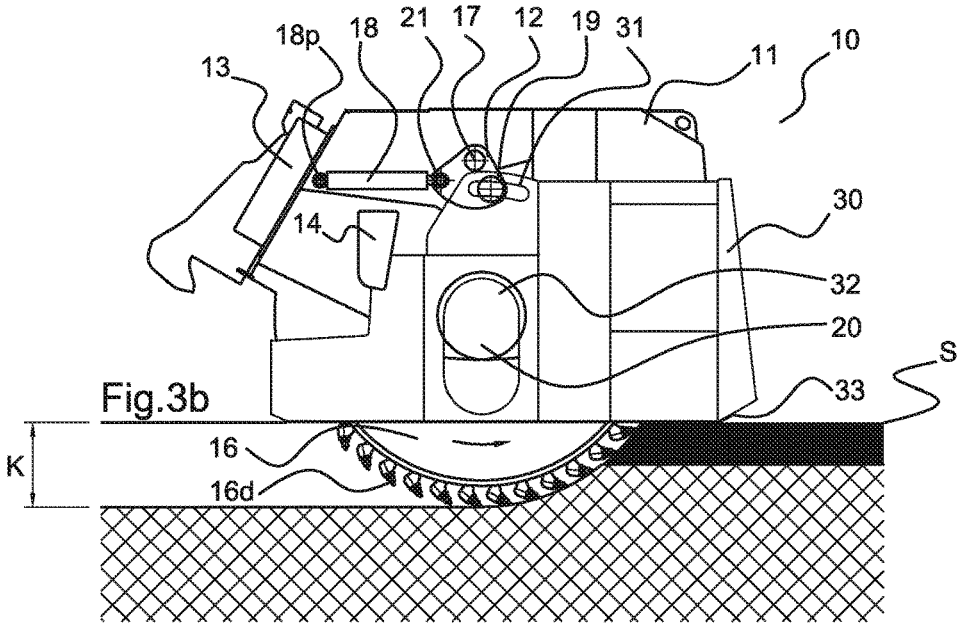

With reference now to FIGS. 2, 3*a* and 3*b* (where the features and/or components parts of the equipment 10 shown in FIGS. 3*a* and 3*b* and possibly already described above with reference to other figures are identified by the same reference numerals), it is further possible to appreciate that equipment 10 comprises a movable adjustment frame 30, which comprises in turn two parallel plates 30*a* and 30*b* defining a space in which the main frame 11 and the fixing and/or adjustment arm 12 are accommodated, where each of the two plates 30*a* and 30*b* comprises a resting foot, which defines a substantially flat resting surface 33 which, during the operations of equipment 10, is arranged to rest on the surface S to be worked, in which the ditch or trench must be dug (see the description above). In particular, the plate 30*a* of the adjustment frame 30 is provided with an engagement slot 31 in which the engagement pole 19 of the fixing and/or adjustment arm 12 is engaged. As shown in particular in FIGS. 3*a* and 3*b*, during the rotation of the fixing and/or adjustment arm 12 in the two opposite rotation directions, clockwise and counterclockwise (FIGS. 1*a* and 1*b*, respectively), the engagement pin 19, in its upward and downward travel, respectively, feeds the adjustment frame 30 with respect to the main supporting frame 11 between the two positions shown in FIG. 3*a* (adjustment frame 30 all up) and FIG. 3*b* (adjustment frame 30 all down), respectively. So, considering that, as mentioned above and shown in the figures, during the operation of equipment 10, the resting surfaces 33 are kept resting on the surface S to be worked, the two reciprocal positions of the adjustment frame 30 with respect to the main supporting frame 11 shown in FIGS. 3*a* and 3*b* correspond to the two conditions and/or configurations of maximum digging depth K and minimum digging depth K, where the adjustment frame 30, with respect to the main supporting frame 11, may obviously assume any intermediate position between the aforesaid two end positions, so that the working depth may be any depth comprised between the maximum depth and the minimum depth described above.

From the above, it can be inferred that, in particular, the arm or the fixing element 12 is shaped as a class 1 lever, in which, in particular, the resistance (constituted by the adjustment frame 30) is applied to an end of the lever or arm (to the pole or pin 19), the effort (generated by the actuating means 18) is applied to the opposite end of the lever or arm 12 (to the axle 21), while the lever fulcrum (constituted by the pivoting pin 17) is placed in intermediate position between the points of application of the resistance and effort, respectively.

Obviously, alternative solutions to the one described above are comprised within the scope of the present invention, such as for example, obtaining the engagement slot 31 in arm 12 instead of in the plate 30*a* of the adjustment frame 30, where in this case the adjustment pin or pole will extend from the plate 30*a* of the adjustment frame 30 to engage the corresponding slot 31.

Solutions for adjusting the different working and/or digging depth from that described above which substantially comprises the arm or the fulcrum 12 and the hydraulic piston 18 are also comprised in the scope of the present invention; for example, solutions which comprise alternatively extensible and retractable adjustment means, e.g. a jack, a hydraulic piston or similar means, interposed directly between the supporting frame 11 and the adjustment frame 30, where the extension direction of said means is substantially parallel to the direction of translation of the adjustment frame with respect to the main frame, which are not shown in the drawings are comprised within the scope of the present invention.

Again with reference to FIGS. 3*a* and 3*b*, it can be further appreciated that the engagement slot 31 has an arc-shaped or semicircular extension (substantially centered on the rotation axis of the digging wheel 16). In the case of equipment according to the present invention, the position of the adjustment frame 30 with respect to the main supporting frame 11, and thus of the digging depth of the digging wheel 16, is adjusted simply by means of the piston 18, in particular by elongating it (to increase the digging depth) and by shortening it (to decrease the digging depth), respectively.

With reference again to FIG. 2 it can be inferred that the element 20 shown here comprises a disc-shaped end portion appended to the end portion 20*a* in which the rotation axle 16*a* is engaged, where the disc-shaped end extends from a substantially cylindrical intermediate portion. The substantially cylindrical intermediate portion of the axle 16*a* extends through an engagement and guiding slot 32*s* which is obtained in the plate 30*a* of the adjustment frame 30. A second engagement and guiding slot 32*d* is obtained in the plate 30*b* of frame 30, where motor 15 extends through the second slot 32*d*. Both slots 32*s* and 32*d* have a substantially oval shape with two substantially rectilinear parallel and opposite sides (the reciprocal distance of which defines the width of the slot), and two opposite semicircular curved sides; furthermore, both slots 32*s* and 32*d* have substantially vertical longitudinal extension (from the bottom upwards in FIG. 2).

In the case of element 20, the diameter of the cylindrical intermediate portion substantially coincides with (or is possible slightly smaller than) the width of slot 32*s*, while the diameter of the disc-shaped portion is slightly greater than the width of slot 32*s*; the accidental release of element 20 from plate 30*a* is thus avoided. In the case of slot 32*d*, its width substantially either coincides with or is slightly larger than the diameter of the portion of motor 15 which extends therethrough, where the diameter of said portion of motor 15 which extends through slot 32*d* is greater than the adjacent portion of motor 15 accommodated in the housing 15*a* of plate 11*a* and thus also the diameter of the housing itself 15*a*. The accidental disengagement of motor 15 from plate 11*a* is thus avoided.

From the above, it is also possible to understand the reason why the two slots 32*s* and 32*d* are also said guiding (in addition to engagement) slots.

Indeed, during the translation of the adjustment frame 30 with respect to the main supporting frame 11 (from the bottom upwards and from the top downwards with respect to the figures) according to the methods explained above (by means of the piston 18 for setting and/or adjusting the working depth), the adjustment frame is guided during its translation by the slots 32*s* and 32*d* in which the cylindrical portion of element 20 and the portion of motor 15 are respectively engaged.

During the rotation of frame 30 with respect to frame 11, instead, frame 30 rotates with respect to the longitudinal axis of the axle 16*a* (and thus of motor 15), where motor 15 and element 20 are free to rotate inside slot 32*d* and slot 32*s*, respectively, and where the rotation travel (with the width of the rotation sector) is defined by the extension of the slot 31 along which the pole or pin 19 can translate.

Figure 3C:
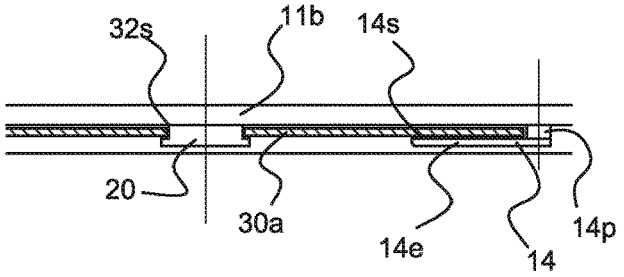
FIG. 3*c* shows a top view of a detail of equipment according to an embodiment of the present invention.

Further guiding means 14 (FIGS. from 3*a* to 3*c*) are further provided along either one side or both opposite sides of the main supporting frame 11, where as shown in FIG. 3*c*, the means 14 comprise a proximity portion 14*p* extending towards the exterior of the plate corresponding to frame 11 (plate 11*b* in the case of the FIGS. 3*a* and 3*c*), and an end portion 14*e*, which is substantially parallel to the respective plate of the main supporting frame 11, so that the proximity portion 14*p* and the end portion 14*e* define an inner space 14*s* in which a portion of the plate corresponding to the adjustment frame 30 (plate 30*a*, in the case of the figures) is accommodated. Alternatively, in the scope of the present invention, the guiding means 14 may be replaced by a system with engagement slots or pins, while the slots 32 and the respective engagement pins 20 will be replaced by guiding means 14.

Figure 4A:
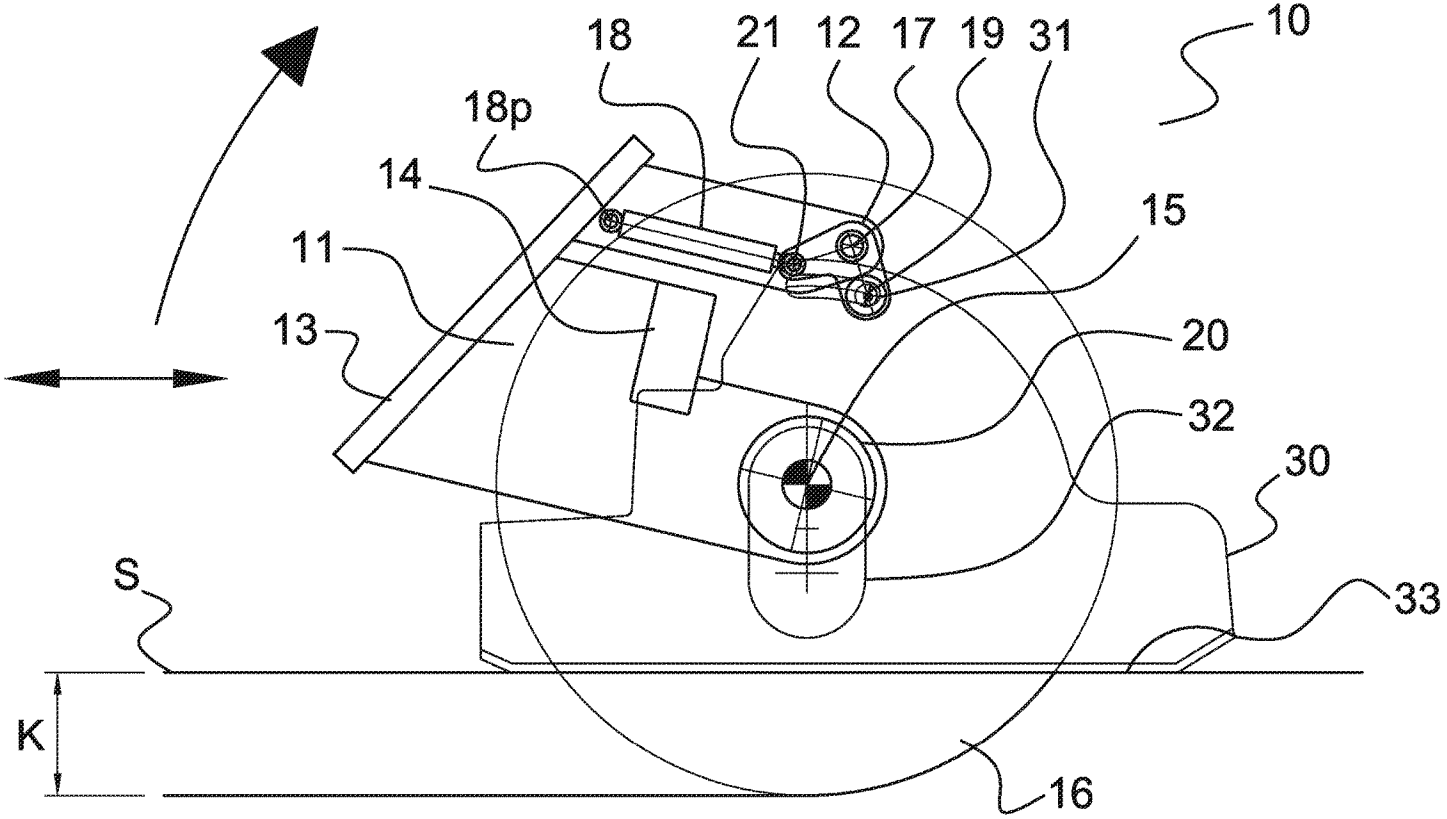
Figure 4B:
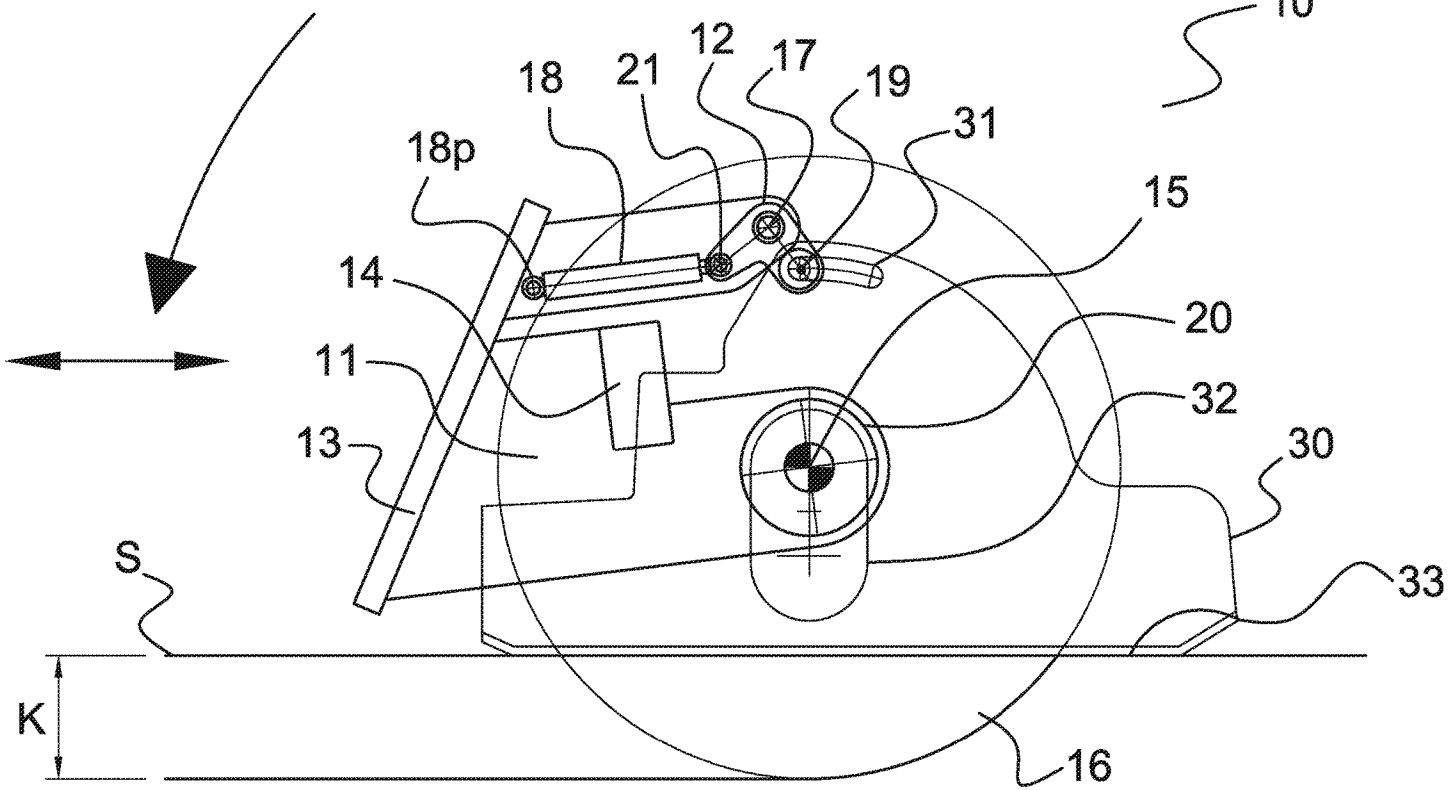
Figure 4C:
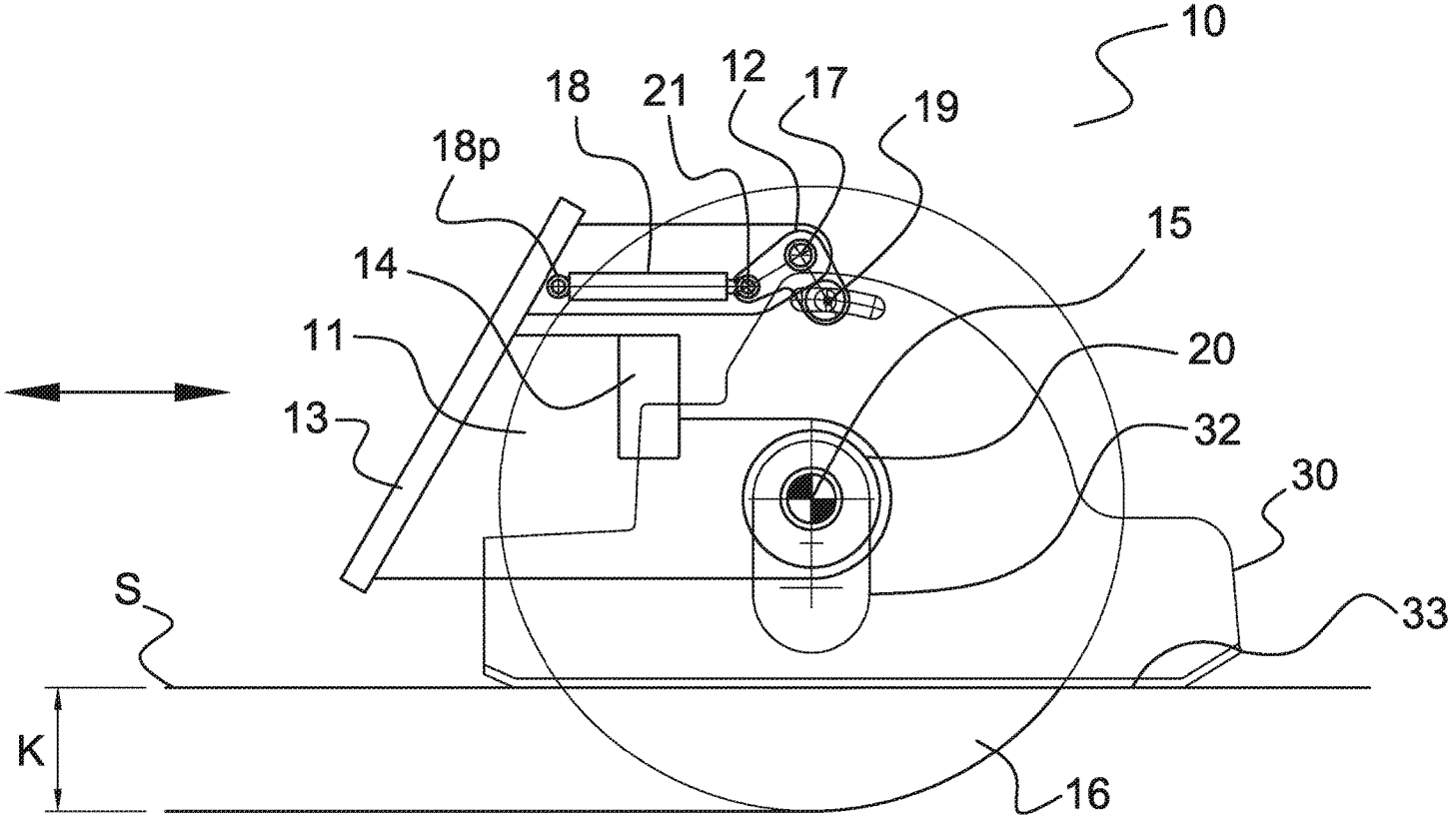

The different functions and purposes of the various parts of the equipment according to the present invention described above will be summarized below with reference to FIGS. 4*a*, 4*b* and 4*c*, where, for clarity, the main supporting frame 11 is show diagrammatically and where moreover the component features and/or parts of the equipment 10 according to the embodiment of the present invention possible already described with reference to the other figures are identified by the same reference numerals. Each of the FIGS. 4*a*, 4*b* and 4*c* show equipment 10 in working position, i.e. with each of the resting surfaces 33 of the plates parallel to the adjustment frame 30 resting on the surfaces S to be worked. Furthermore, in each of the FIGS. 4*a*, 4*b* and 4*c* the working or digging depth K is the same because the extension of the actuating means 18 is the same in the figures.

What changes in FIGS. from 4*a* to 4*c* is the position of the attachment 13 of the main frame 11, where FIG. 4*a* represents attachment 13 in its highest position (with respect to the surface S), FIG. 4*c* represents the intermediate highest position and FIG. 4*b* represents the lowest position. As mentioned above, the various positions of attachment 13 may be due to variations in the working conditions and for example to haphazard, inaccurate or in all cases unintentional maneuvers.

A different angle of the attachment 13 (and thus of the main frame 11) correspond to each of the different heights of attachment 13 with respect to the surface S with respect to the vertical, the attachment and the frame 11 being more inclined counterclockwise in the condition of FIG. 4*a* (maximum height), less inclined in the intermediate height condition (FIG. 4*c*) and even less inclined in the minimum height condition (FIG. 4*b*).

In other words, for clarity and from the working condition shown in FIG. 4*c*, it can be inferred that in case of lifting of attachment 13, the main frame 11 will be rotated counterclockwise with respect to a rotation axis of the digging means 16. But the adjustment frame 30, will not be rotationally fed in the same rotation direction as the main frame 11 by virtue of the engagement guide 31 (in which the respective engagement pole 20 may freely translate), and element 20 and motor 15 may rotate respectively in the slots 32*s* and 32*d*, so that the adjustment frame 30 will remain in the position shown in FIG. 4*c*, i.e. with the resting surfaces perfectly resting on the surface S. So, the adjustment frame 30 can translate with respect to the main frame 11 (along the slots 32*s* and 32*d*) to allow to adjust the working depth and the main frame 11 and the adjustment frame 30 are mutually and rotationally disengaged, i.e. the rotation of the main frame 11 between the two limit stop positions shown in FIGS. 4*a* and 4*b* (with the engagement pole 19 at the opposite ends of the respective slot 31) does not translate into a rotation of the adjustment frame 30, which on the contrary is kept in the ideal working condition, i.e. with the resting surfaces 33 perfectly resting on the surfaces to be worked S.

The above can be appreciated in a particularly direct manner with reference to FIGS. 5, 6*a* and 6*b*, in which equipment 10 is coupled to a main operating machine 100, where the movable arm or support 101 of machine 100 is coupled to the attachment 13 of equipment 10, for which reference should be made to the previous description with reference to FIGS. 5, 6*a* and 6*b*.

It has thus been demonstrated, by means of the above detailed description of the embodiments of the present invention shown in the drawings, that the present invention can achieve the set purposes and/or overcome or at least minimize the typical drawbacks of the solutions according to the prior art.

In particular, according to the present invention, the main frame and the adjustment frame are not rotationally constrained, thus where, also in case of accidental rotation of the supporting frame the adjustment frame remains in the desired position, i.e. with the resting surfaces always perfectly resting on the surfaces to be worked, so that accumulations of waste material under the resting surfaces is avoided, thus keeping the working depth constant.

Furthermore, the equipment according to the present invention allows to accurately and reliably adjust the reciprocal position of the adjustment frame and of the supporting frame and thus of the digging depth, as well as a wide reciprocal rotation of the adjustment frame and of the main frame.

Finally, according to the present invention, for the reciprocal rotation of the adjustment frame and of the main frame, the accommodation housings of the power source and/or of the rotation axle of the digging wheel are exploited where, thus, according to the present invention the entire structure is neither weakened nor burdened by additional constraints, and where finally the reciprocal rotation of the two frames is obtained by means of solutions which are simple to be implemented and/or manufactured and thus are low cost.

Although the present invention is explained above by means of a detailed description of the embodiments thereof shown in the drawings, the present invention is not obviously limited to the embodiments described above and shown in the drawings; on the contrary, all variants and embodiments described and shown will appear obvious and immediate to those skilled in the art. For example, according to an alternative embodiment, the guiding means 14 may be replaced by a pair of further guides or slots, each obtained in a side wall of the guiding frame or of the main frame and in which an engagement pole or guide is engaged which extends towards the exterior of the main supporting frame or towards the interior of the guiding frame 30, respectively. Likewise, slot 32*s* and the respective element 20 may be replaced by guiding means 14 of the type described above (FIG. 3*c*). Furthermore, according to further alternative embodiments, the power sources for the actuating means 18 and the digging means may be respectively either in common or independent, where the actuating means 18 and 15, in particular if of hydraulic type, may be possibly also connected to the main hydraulic circuit of the operating machine 100.

Again the hydraulic piston 18 may be replaced, for example, by a manually adjustable jack. Furthermore, the possible applications of the present invention are not limited to wheel and/or chain trenchers, but are applicable to all the equipment where adjusting the working depth is appropriate, e.g. demolition equipment, milling equipment o similar equipment.

The scope of the present invention is thus defined by the claims.

The invention claimed is:

1. Equipment for excavating solid surfaces or floors, said equipment comprising a main supporting frame and rotatable working or digging tool rotationally fixed to said main supporting frame, a power source for actuating said working or digging tool and fixed to said main supporting frame, and an adjustment frame defining at least one substantially flat contact portion adapted to be placed in contact with a corresponding portion of the surface or floor to be worked; wherein said adjustment frame comprises a first guiding slot through which at least one portion of said power source extends, said power source being translatable within said first slot, said adjustment frame being thus translatable with respect to said main supporting frame, wherein the translation of said adjustment frame is defined by the reciprocal engagement of said at least one portion of said power source and said first guiding slot; wherein said power source defines a longitudinal extension axis and in that said adjustment frame is rotatable about said main supporting frame with respect to said longitudinal extension axis of said power source; wherein said main supporting frame and said adjustment frame are reciprocally fixed by an engagement pole or pin extending in a direction substantially parallel to said longitudinal extension axis of said power source, wherein said engagement pole or pin engages a second engagement slot, and wherein said second engagement slot extends along an arc-shaped or semi-circular development or path centered on said longitudinal extension axis of said power source, said engagement pin or pole being translatable along said second engagement slot on a plane which is substantially perpendicular to said longitudinal extension axis of said power source.

2. The equipment according to claim 1, wherein said second engagement slot is formed in said adjustment frame.

3. The equipment according to 2, further comprising a third guiding slot in which a guiding element is engaged, which extends along a direction parallel to the extension direction of said pin or pole, said guiding element being translatable along said third guiding slot, and said third guiding slot and said first guiding slot extend along developments or paths which substantially overlap according to a side view substantially parallel to said longitudinal extension axis of said power source.

4. The equipment according to claim 3, wherein said third guiding slot is formed in said adjustment frame and said guiding element extends outwards from said main supporting frame.

5. The equipment according to claim 4, wherein said guiding element defines a longitudinal extension axis which coincides with said longitudinal extension axis of said power source.

6. The equipment according to 5, further comprising a guide defining an engagement space in which a portion of said adjustment frame or of said main supporting frame is slidingly accommodated.

7. The equipment according to claim 6, wherein said guide comprises a proximity portion which extends along a direction which is substantially parallel to said longitudinal extension axis of said power source and an end portion extending from said proximity portion substantially perpendicular to said longitudinal extension axis of said power source.

8. The equipment according to claim 7, wherein said proximity portion extends outwards from said main supporting frame.

9. The equipment according to claim 8, further comprising an adjustor configured to enable adjustment of the position of said adjustment frame with respect to said main supporting frame to thereby adjust a working depth of said working or digging tool.

10. The equipment according to claim 9, wherein said adjustor comprises a first fixing arm rotationally fixed to said main supporting frame, wherein said adjustment frame is fixed to said main frame such that by rotating said fixing arm about the rotation axis thereof in two opposite rotation directions, a translation of said adjustment frame is obtained with respect to said main supporting frame in two opposite translation directions, respectively.

11. The equipment according to claim 10, wherein said fixing arm is shaped as a class 1 lever, wherein said adjustment frame is rotationally fixed to a first end portion of said fixing arm which comprises the point of application of the resistance of said lever.

12. The equipment according to claim 11, wherein said engagement pole or pin extends from said first end portion of said fixing arm in a direction perpendicular to the rotation plane of said arm, and the end portion of said pole or pin opposite to said arm being engaged in said second engagement slot of said adjustment frame.

13. The equipment according to claim 12, wherein the second end portion of said fixing arm opposite to said first end portion, which comprises the point of application of the effort and said first end portion, extend along non-parallel directions converging in the rotation axis of said lever.

14. The equipment according to claim 13, wherein the angle subtended by said first and second end portions of said fixing arm is smaller than 180°.

15. The equipment according to claim 14, wherein said equipment comprises an alternatively extensible and retractable actuator applied to said second end portion of said fixing arm, wherein extension of said actuator translates into a rotation of said arm in one rotation direction while retraction of the said actuating actuator into a rotation of said arm in the opposite rotation direction.

16. An operating machine according to claim 1 configured for digging through solid surfaces including at least one of asphalt and concrete.

17. The operating machine according to claim 16, wherein said equipment is fixed to said operating machine by means of a hydraulically actuated working arm or support.

18. The operating machine according to claim 17, wherein said actuator and/or the working or digging tool are hydraulic, respectively, and hydraulically actuated and connected to a main hydraulic circuit of said operating machine.

* * * * *